US007314260B2

(12) United States Patent
Mizude et al.

(10) Patent No.: US 7,314,260 B2
(45) Date of Patent: Jan. 1, 2008

(54) INK JET PRINTER, INK JET PRINTING METHOD, INK JET PRINT PROGRAM, AND MEDIUM RECORDING THAT PROGRAM

(75) Inventors: Kazuhiro Mizude, Kyoto (JP); Hiroshi Ishii, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 144 days.

(21) Appl. No.: 10/520,419

(22) PCT Filed: Jul. 7, 2003

(86) PCT No.: PCT/JP03/08584

§ 371 (c)(1),
(2), (4) Date: Jan. 6, 2005

(87) PCT Pub. No.: WO2004/005031

PCT Pub. Date: Jan. 15, 2004

(65) Prior Publication Data

US 2005/0264592 A1 Dec. 1, 2005

(30) Foreign Application Priority Data

Jul. 8, 2002 (JP) ..... 2002-198589

(51) Int. Cl.
*B41J 29/38* (2006.01)

(52) U.S. Cl. ..... 347/9; 347/5; 347/19

(58) Field of Classification Search ..... 347/9, 347/14, 19, 37, 5, 12

See application file for complete search history.

(56) References Cited

U.S. PATENT DOCUMENTS

| | | | | |
|---|---|---|---|---|
| 5,988,784 | A | 11/1999 | Takemura et al. | |
| 6,419,338 | B1 * | 7/2002 | Ikeda | 347/14 |
| 2003/0043220 | A1 | 3/2003 | Shoji | |

FOREIGN PATENT DOCUMENTS

| | | | |
|---|---|---|---|
| JP | 63-25511 | A | 2/1988 |
| JP | 6-67729 | A | 3/1994 |
| JP | 2000-289253 | A | 10/2000 |
| JP | 2002-11909 | A | 1/2002 |
| JP | 2003-225999 | A | 8/2003 |

* cited by examiner

*Primary Examiner*—Lam Son Nguyen
(74) *Attorney, Agent, or Firm*—Birch, Stewart, Kolasch & Birch, LLP

(57) ABSTRACT

An inkjet print device prints by reciprocally moving a carriage (15) in a main scan direction while controlling ink ejection from a print head (17) according to information on the position of the carriage (15) both in a forward movement and in a return movement. An encoder (22), a first U/D counter (29), a second U/D counter (30), a timer (31), and an interval timer (32) senses the position of the carriage (15). The encoder (22), the first U/D counter (29), and the timer (31) senses the speed of the carriage (15). A TBL memory (33) is used in determining a positional correction quantity at a sensed carriage speed from a positional correction quantity at a predetermined carriage speed. A head control section (26) controls ink ejection from the print head (17) based on the carriage position and the positional correction quantity.

2 Claims, 13 Drawing Sheets

INK JET PRINTER, INK JET PRINTING METHOD, INK JET PRINT PROGRAM, AND MEDIUM RECORDING THAT PROGRAM

TECHNICAL FIELD

The present invention relates to inkjet printers and like inkjet print devices, in particular, those inkjet print devices which print by reciprocally moving a carriage carrying a print head in a main scan direction while controlling ink ejection from the print head according to information on the position of the carriage both in a forward movement and in a return movement.

BACKGROUND ART

In an inkjet print device of this type, the carriage, in its movement in the main scan direction, temporarily halts at each end of its mobility range before going on in an opposite direction. Thus, there is an accelerate/decelerate area at each end of the mobility range and a constant-speed area there between.

In addition, as the print head ejects ink while the carriage is moving, the ink hits recording paper at a position somewhat ahead of where it was ejected with respect to the direction of the movement. Therefore, if ink is ejected when the carriage is at the same position in the forward and return directions, aiming at the same position on an image with respect to the main scan direction, the ink hits different positions. To avoid such off-target hitting, the ink eject position needs be corrected at least either in the forward movement or in the return movement to hit the same position on the image.

The magnitude of the discrepancy between the ink eject position and the ink hitting position varies with the moving speed of the carriage (hereinafter, "carriage speed"). The ink eject position can be corrected relatively easily in the constant-speed area, but difficult in the accelerate/decelerate areas. In conventional inkjet print devices, therefore, print areas are specified inside the constant-speed area so that the print device prints only inside the constant-speed area.

Problems arise with the specification of print areas only inside the constant-speed area in the conventional inkjet print device. Printing takes time because of the presence of the accelerate/decelerate areas extending from the ends of the constant-speed area. For the same reason, the device is bulky too.

Further, the inkjet print device senses the carriage position with a linear encoder. Commercially available encoder have a maximum resolution of 150 dpi, whilst the image printed on recording paper has a resolution of 600 to 1200 dpi. The encoder output cannot be used straightly as position information to control ink ejection in high resolution printing.

DISCLOSURE OF INVENTION

The present invention, conceived to address these problems, has an objective to provide an inkjet print device capable of high resolution printing in the accelerate/decelerate areas that flank the constant-speed area for reduced print time and reduced device size.

To achieve the objective, an inkjet print device in accordance with the present invention is an inkjet print device which prints by reciprocally moving a carriage carrying a print head in a main scan direction while controlling ink ejection from the print head according to a carriage position both in a forward movement and in a return movement, and is characterized in that the device contains: position sensing means for sensing the carriage position; speed sensing means for sensing moving speed of the carriage; correction quantity determining means for presetting a relationship between the speed of the carriage and a positional correction quantity for correcting a discrepancy in an ink hitting position resulting from the ink ejection from the print head while the carriage is moving and for determining the positional correction quantity from the carriage speed sensed by the speed sensing means according to the preset relationship; and ejection control means for controlling the ink ejection from the print head according to the positional correction quantity determined by the correction quantity determining means and the carriage position sensed by the position sensing means.

According to the arrangement, even if the carriage speed changes, a suitable positional correction quantity is obtainable according to the relationship between the positional correction quantity and the carriage speed. Thus, the ink ejection from the print head is controlled based on a suitable positional correction quantity. Good image quality is available even while the carriage is accelerating or decelerating. Hence, the device can print in the accelerate/decelerate areas flanking the constant-speed area, achieving reduced print time and reduced device size.

For a fuller understanding of the nature and advantages of the invention, reference should be made to the ensuing detailed description taken in conjunction with the accompanying drawings.

BRIEF DESCRIPTION OF DRAWINGS

FIG. 4(*a*) is related to the inkjet printer of the present embodiment, and FIG. 4(*b*) to the conventional inkjet printer.

BEST MODE FOR CARRYING OUT THE INVENTION

Referring to figures, the following will describe an embodiment in which the present invention is applied to an inkjet printer.

Figure 1:
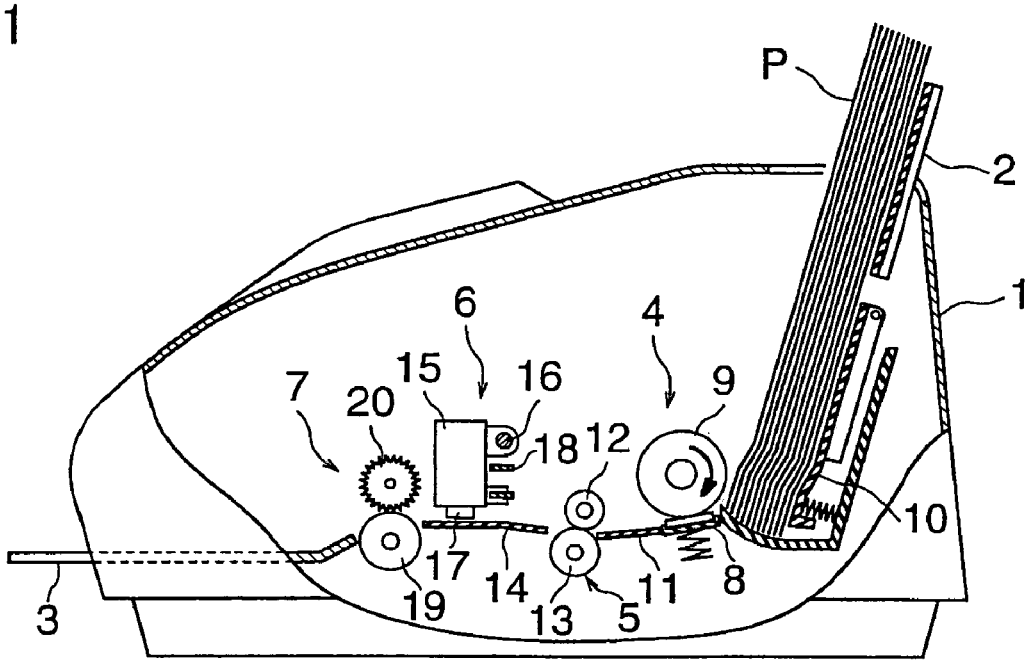
FIG. 1 is a partially exploded side view showing major features of an inkjet printer which is an embodiment of the present invention.
Figure 2:
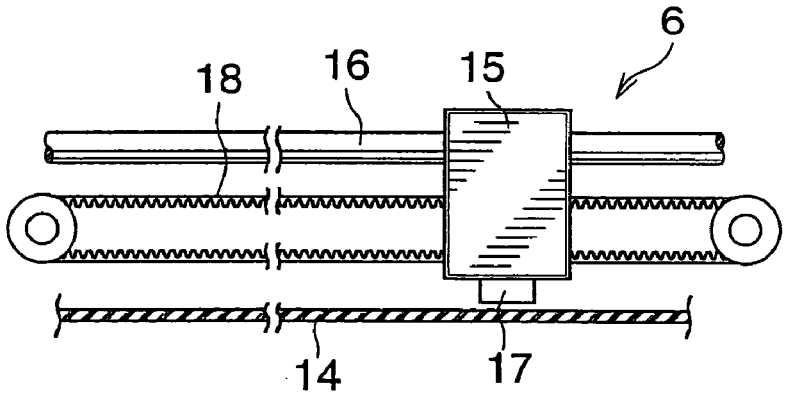
FIG. 2 is a front view showing part of the structure inside the inkjet printer.

FIG. 1 is a schematic showing the overall structure of an inkjet printer. In the following, directional descriptions will be given with respect to a transport direction of recording paper (detailed later). The front refers to the downstream direction, and the back to the upstream. The left/right are defined as looking at the front. Thus, in FIG. 1, the left-hand side is the front, the right-hand side is the back, the front of the paper is the left, and the back of the paper is the right. FIG. 2 illustrates a part of the internal structure of the inkjet printer in FIG. 1 as viewed from the front.

In the following, ordinary numerals represent decimal numbers, while bracketed numerals and letters, A to F, represent hexadecimal numbers. An A, B, C, D, E, and F in hexadecimal notation are equal to a decimal 10, 11, 12, 13, 14, 15, and 16 respectively.

Referring to FIG. 1, the device main body of the printer is a box housing (1). There are provided a paper feed tray (2) in the far back of the housing (1) and a paper discharge tray (3) in the near front of the housing (1). Between the paper feed tray (2) and the paper discharge tray (3) in the housing (1) are provided a paper feed section (4), a transport section (5), a print section (6), and a paper discharge section (7).

The paper feed tray (2) contains one or more pieces of recording paper (P) with the print surface looking forward, but slightly upward. The paper feed section (4) supplies recording paper (P) a piece at a time from the paper feed tray (2) to the transport section (5). The paper feed section (4) includes a separator device (8) and a paper feed roller (9). The separator device (8) is positioned slightly toward the front from, and lower than, the bottom end of the recording paper (P) on the paper feed tray (2). The paper feed roller (9) presses down the separator device (8). The paper feed tray (2) has a press device (10) which moves the recording paper (P) toward the paper feed roller (9) to feed the paper to the roller (9).

The transport section (5) transports recording paper (P) fed from the paper feed section (4) to the print section (6). The transport section (5) includes a guide board (11) toward the front from the separator device (8) and a pair of top and bottom supply rollers (12), (13) further toward the front.

The print section (6) prints on recording paper (P) coming from the transport section (5). The print section (6) includes a platen (14) toward the front from the pair of supply rollers (12), (13) and a carriage (15) above the platen (14).

Now referring to FIG. 2, the print section (6) includes a guide bar (16) extending in the left/right directions which matches the main scan directions. The carriage (15) sits on the guide bar (16) so that it is movable. A print head (17) is mounted on the bottom of the carriage (16). Although not shown in the figure, a set of ink nozzles is formed on the bottom of the print head (17). The carriage (15) is mounted to a timing belt (18) driven by an electromotor (DC motor) which is omitted from FIG. 1. Thus, the carriage (15) is reciprocally moved in the left/right directions along the guide bar (16).

The paper discharge section (7) discharges recording paper (P) printed by the print section (6) from the paper discharge tray (3). The paper discharge section (7) includes a paper discharge roller (19) toward the front, and lower than, the platen (14) and a spur (20) pressing down the paper discharge roller (19).

For the printer to print, first, the press device (10) acts to press, again the paper feed roller (9), the bottom end (front end) of a piece of recording paper (P) which is closest to the front on the paper feed tray (2). Thanks to the rotation of the paper feed roller (9) and the action of the separator device (8), that sheet alone is moved on the guide board (11) and fed between the supply rollers (12), (13). The supply rollers (12), (13) rotate in concert with the action of the print section (6). After transporting recording paper (P) to a predetermined print start site for the print section (6), the supply rollers (12), (13) transport moves the recording paper (P) toward the front by a predetermined pitch at a time. Meanwhile, the carriage (15) is reciprocally moved in the left/right directions so that the print section (6) prints on a surface (top face) of the recording paper (P). The front part of the recording paper (P) where printing is over is moved toward the front by the paper discharge roller (19) and the spur (20). After the completion of the printing, the recording paper (P) is discharged passing between the paper discharge roller (19) and the spur (20) onto the paper discharge tray (3).

In this printer, the carriage (15) is reciprocally moved in the left/right directions, and ink ejection from the print head (17) is controlled according to information on the position of the carriage (15) while the carriage is moving in a forward direction and in a return direction to accomplish printing.

Here, the left/right directions (main scan direction) which are the scan direction for the carriage (15) are designated as an x direction. The forward/backward directions (auxiliary scan direction) which are the transport direction for the paper (P) is designated as a y direction. In addition, a movement of the carriage (15) in the increasing direction on the x axis is defined as a forward movement, and a movement of the carriage (15) in the decreasing direction on the x axis is defined as a return movement.

Figure 3:
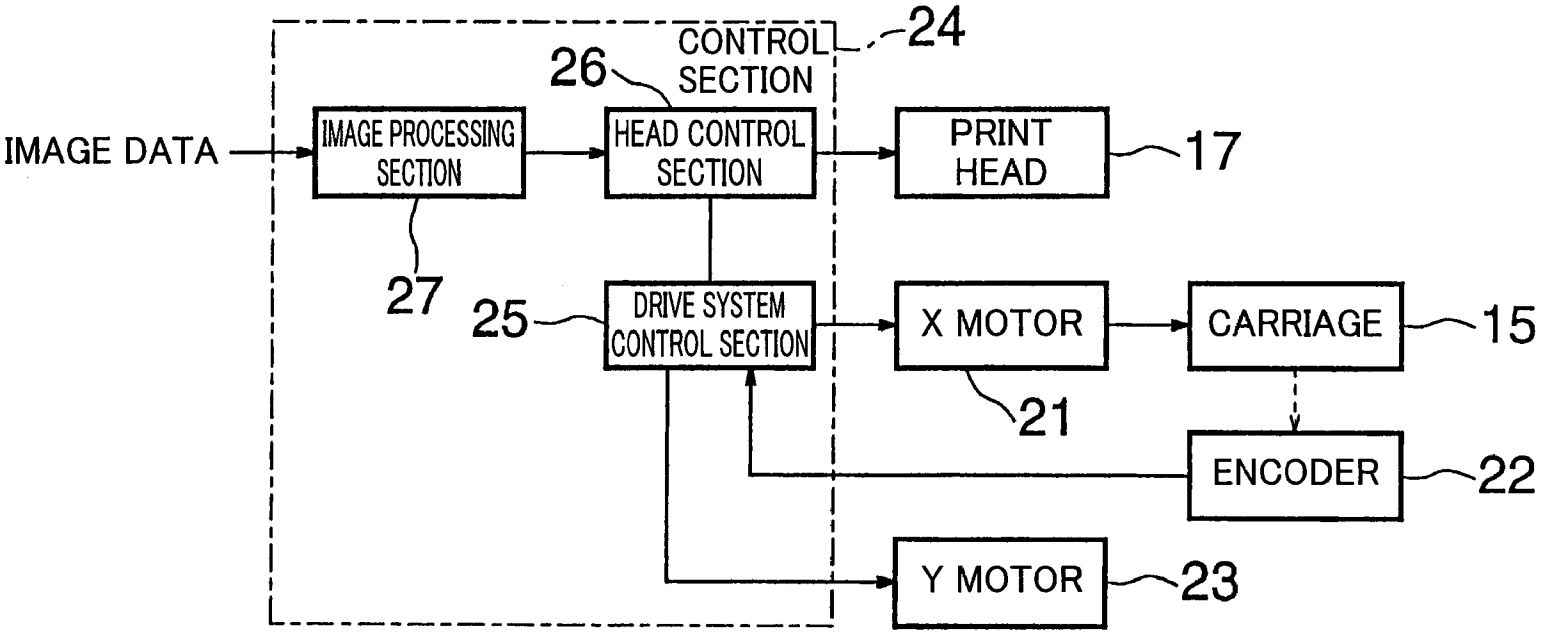
FIG. 3 is a block diagram showing, as an example, the electrical arrangement of a major part of the inkjet printer.

FIG. 3 illustrates an exemplary electrical arrangement of parts of the print section (6) associated with the transport of the paper (P), motion of the carriage (15), and control of ink ejection from the print head (17). In the figure, an X motor (21) is the aforementioned electromotor moving the carriage (15) in the left/right directions. A linear encoder (22) senses the position of the carriage (15) in the left/right directions. A Y motor (23) is an electromotor (pulse motor) driving the supply roller (13) and the paper discharge roller (19) to transport the paper (P).

The printer includes a control section (24) controlling the whole printer. The control section (24) may be a CPU or other compute means executing computer programs loaded into a ROM, RAM, or other storage means.

The control section (24) includes, among others, a drive system control section (25) controlling a drive system including the X motor (21), the Y motor (23), etc., a head control section (26) controlling the print head (17), and an image processing section (27) processing image data and transmitting it to the head control section (26) for a printout.

Figure 4:
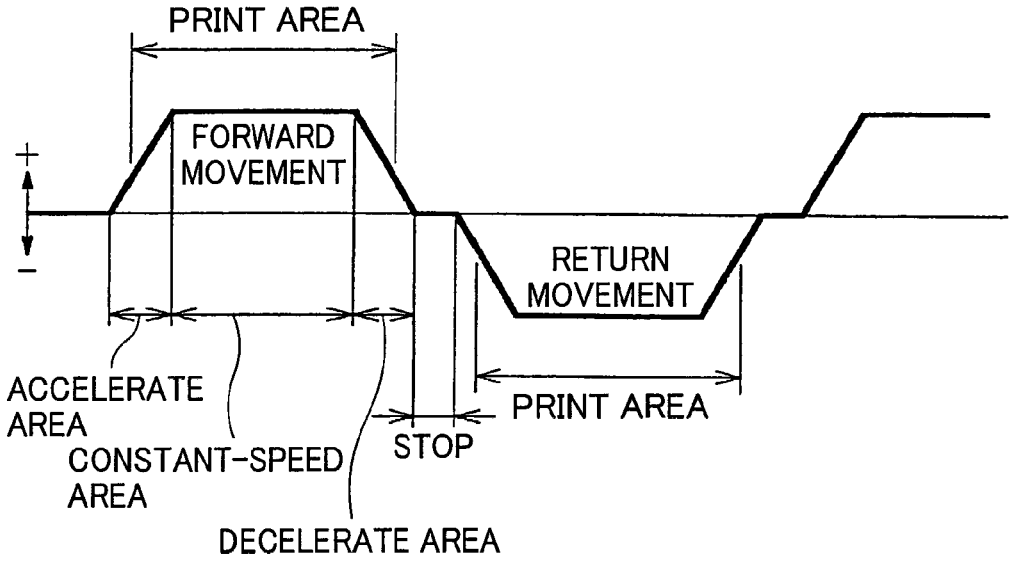
FIGS. 4(*a*), 4(*b*) are illustrations showing how a carriage speed changes with print areas.
Figure 4:
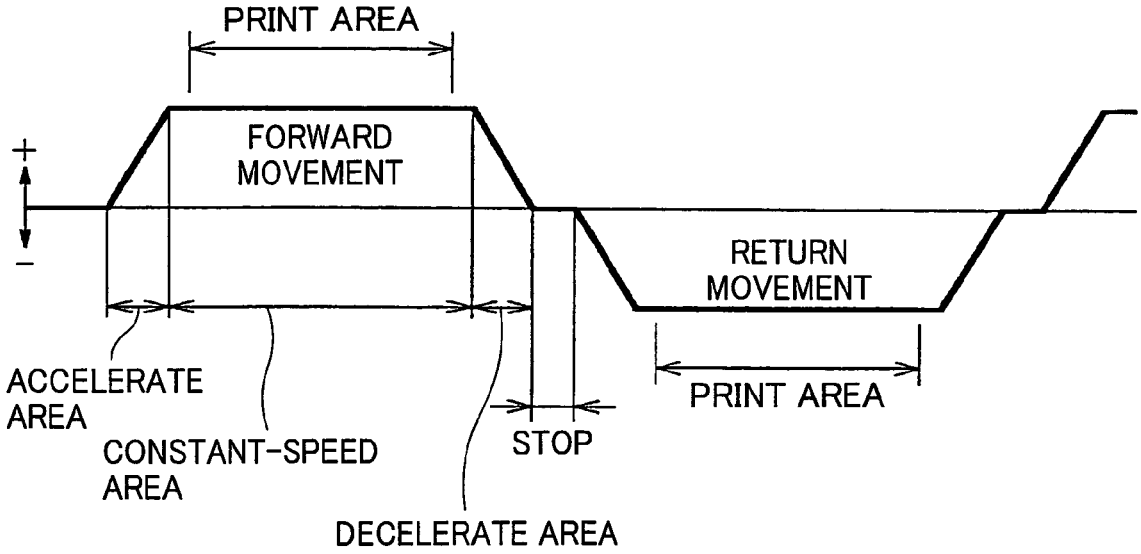

FIGS. 4(*a*), 4(*b*) show changes in the speed of the carriage (15) in its movement in the left/right directions. They also show a relationship between a mobility range of the carriage (15) and a print area. FIG. 4(*a*) relates to the printer in accordance with the present embodiment. FIG. 4(*b*) relates to a conventional printer.

As shown in FIGS. 4(*a*), 4(*b*), there are accelerate/decelerate areas at the left/right ends of the mobility range of the carriage (15) and a constant-speed area there between.

The conventional printer (see FIG. 4(*b*)) has no print area outside the constant-speed area. In contrast, the printer in accordance with the present embodiment has an expanded print area inclusive of the constant-speed area and the accelerate/decelerate areas flanking that area.

The head control section (26) controls ink ejection from the print head (17) according to information on the position of the carriage (15) in the left/right directions. Further, to correct for the discrepancy in the ink hitting position resulting from the print head (17) ejecting ink while the carriage (15) is moving in the accelerate/decelerate areas, the head control section (26) implement the following procedures. The position and speed of the carriage (15) are sensed. A positional correction quantity at a sensed carriage speed is calculated from a positional correction quantity at a predetermined carriage speed. Ink ejection from the print head (17) is controlled on the basis of the sensed carriage position and the positional correction quantity.

As described, as the print head (17) ejects ink while the carriage (15) is in motion, the ink hits the recording paper (P) at a position forward from the ink eject position with respect to the direction in which the carriage is moving. The magnitude of the discrepancy in the ink hitting position varies with the speed of the carriage (15).

Figure 5:
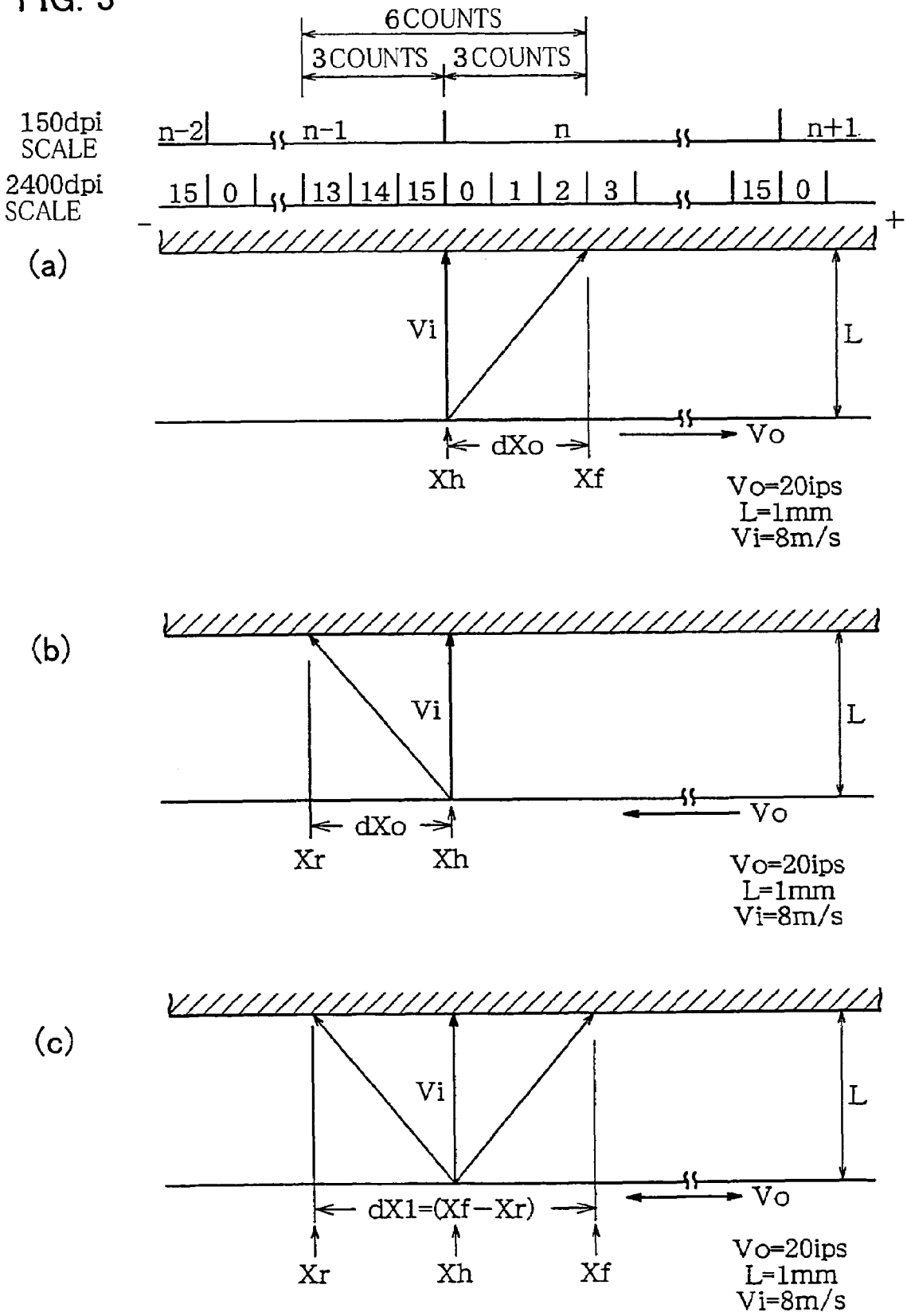
FIG. 5 are drawings illustrating a discrepancy between the ink eject position and the ink hitting position.

FIG. 5 show discrepancy between the ink eject position and the ink hitting position. FIG. 5(*a*) shows a discrepancy occurring in the forward movement. FIG. 5(*b*) shows a discrepancy in the return movement. FIG. 5(*c*) shows a discrepancy in the forward movement combined with a discrepancy in the return movement. In FIG. 5, the right-hand side is the positive direction of the x axis, and the left-hand side is the negative direction of the x axis.

Referring to FIG. 5(*a*) showing the forward movement, an ink hitting position Xf is more positive on the x axis than an ink eject position Xh. Referring next to FIG. 5(*b*) showing the return movement, the ink hitting position Xr is more negative on the x axis than the ink eject position Xh. If the carriage speed is equal, the magnitude of discrepancy either in the forward movement or in the return movement ("single-direction discrepancy") is equal to that in the other direction. The single-direction discrepancy when the carriage speed is V0 is indicated by dX0.

Figure 6:
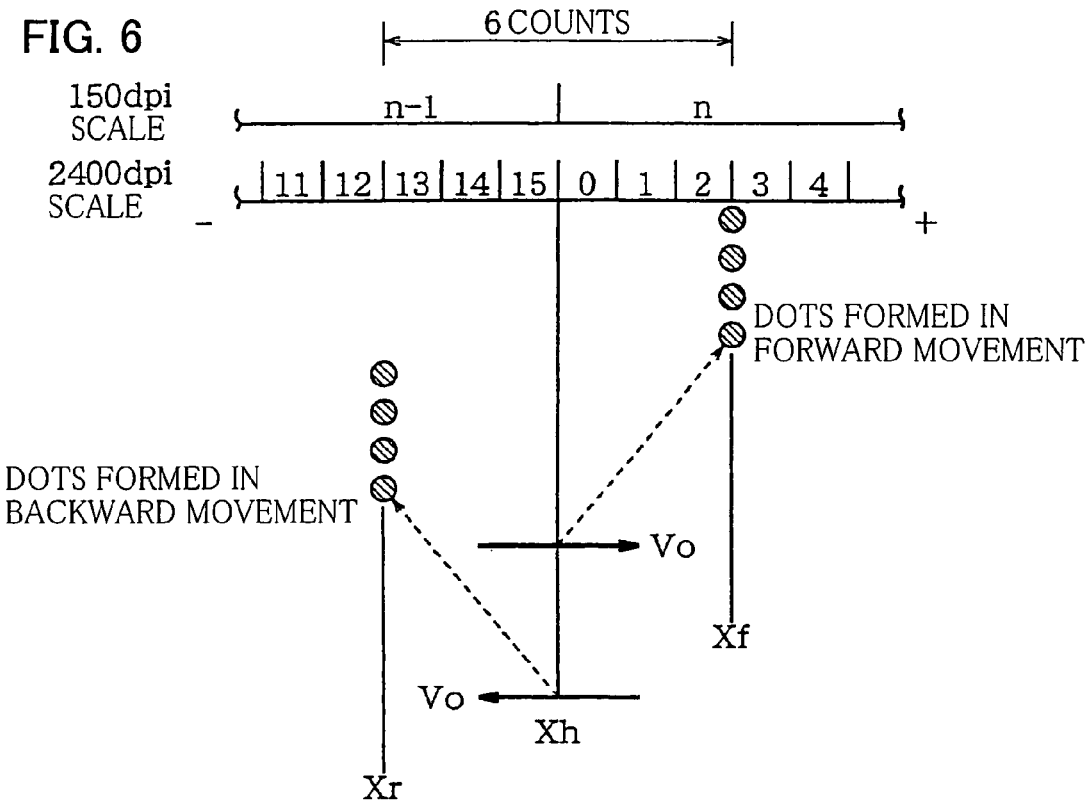
FIG. 6 is a drawing illustrating discrepancies in the positions of those dots formed in a forward movement and those dots formed in a return movement.

Assume, for example, that: the carriage speed V0 is 10 ips (inches per second); the distance, L, from the print head (17) to the recording paper (P) is 1 mm; the speed, Vi, at which ink is ejected from the print head (17) is 8 m/s, and the single-direction discrepancy dX0 is equivalent to 3 dots at 2400 dpi. Now referring to FIG. 5(*c*), ink is ejected at the same ink eject position Xh in the forward movement and in the return movement. The discrepancy, dX1 (=Xf−Xr), between the ink hitting position Xf in the forward movement and the ink hitting position Xr in the return movement (double-direction discrepancy) is a sum of a discrepancy in the forward movement and a discrepancy in the return movement. Assuming that the carriage speed is V0 both in the forward movement and the return movement, the double-direction discrepancy dX1 is twice the single-direction discrepancy dX0. FIG. 6 shows discrepancies between the dots formed in the forward movement and those formed in the return movement under these conditions.

The ink ejection control is done taking the carriage speed V0 as a reference and either the single-direction discrepancy dX0 at the reference speed V0 as a reference correction quantity (single-direction reference correction quantity) or the double-direction discrepancy dX1 at the reference speed V0 as a reference correction quantity (double-direction reference correction quantity).

Figure 7:
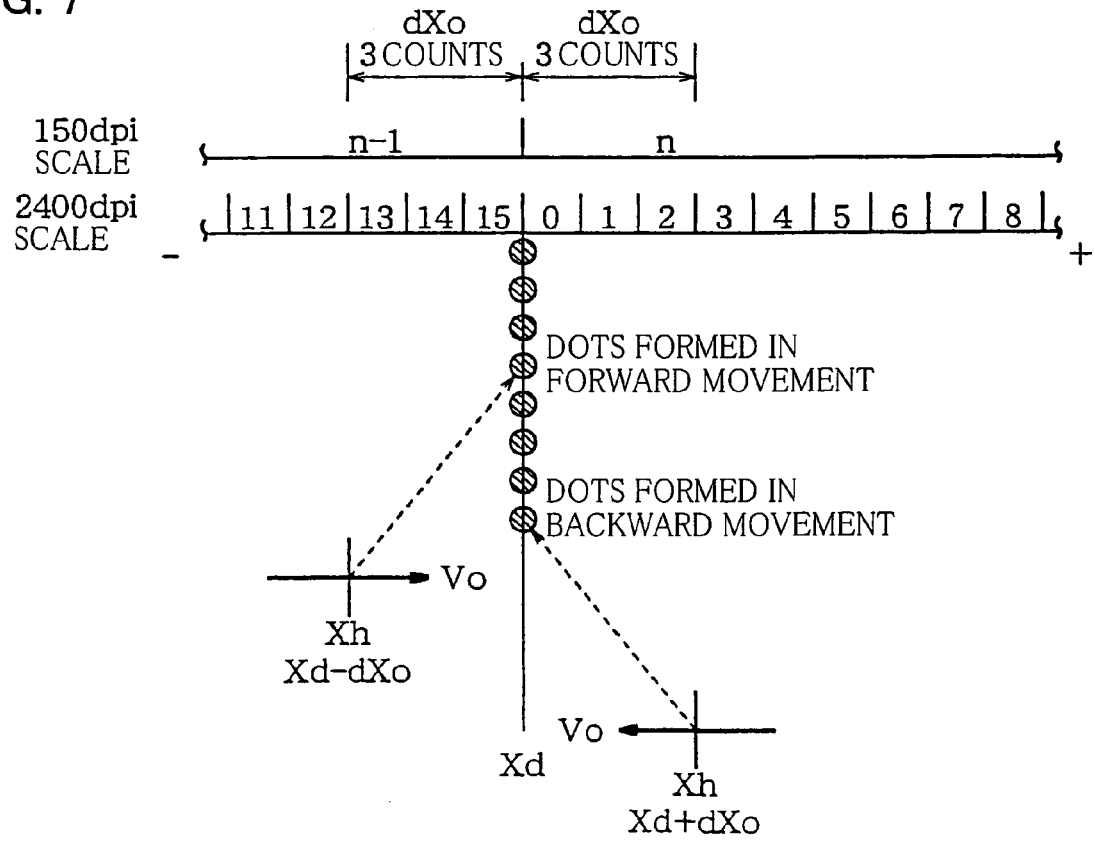
FIG. 7 is a drawing illustrating matching of the dots formed in the forward movement and the dots formed in the return movement after correction in the forward movement and in the return movement.

FIG. 7 shows a control based on the single-direction reference correction quantity dX0. In this case, the control is done based on the single-direction reference correction quantity dX0 so that the ink ejected at a dot position Xd in an image in the return movement can hit the same position on paper (P) as the ink ejected at the same dot position Xd in the forward movement.

FIG. 7 assumes an equal speed of V0 in the forward movement and in the return movement. Under these conditions, when the carriage reaches the ink eject position Xh in the forward movement, ink is ejected aiming at a dot position (=Xh+dX0) on the image which is more positive than the position Xh by the single-direction reference correction quantity dX0. Then, when the carriage reaches the ink eject position Xh in the return movement, ink is ejected aiming at a dot position (=Xh−dX0) on the image which is more negative than the position Xh by a single-direction reference correction quantity dX0. As a result, as shown in FIG. 7, aiming at the same dot position Xd on the image, ink is ejected when the carriage reaches the ink eject position Xh (=Xd−dX0) which is more negative than the dot position Xd by the single-direction correction quantity dX0 in the forward movement and when the carriage reaches the ink eject position Xh (=Xd+dX0) which is more positive than the dot position Xd by the single-direction correction quantity dX0 in the return movement.

The single-direction discrepancy is substantially proportional to the carriage speed. Therefore, if the carriage speed is not equal to the reference speed V0, a single-direction correction quantity dX(t) is calculated as given by equation (1) from the reference speed V0, the single-direction reference correction quantity dX0, and the sensed carriage speed V(t). A similar ink ejection control is possible based on this single-direction correction quantity dX(t).

$$dX(t)=dX0\times V(t)/V0 \quad (1)$$

The single-direction positional correction quantity is also obtainable from a sensed carriage speed in reference to a correction quantity table prepared in advance. The table contains single-direction positional correction quantities at given carriage speeds. The table can be created through proportionality computation on the single-direction reference correction quantity dX0 at the reference speed V0.

Figure 8:
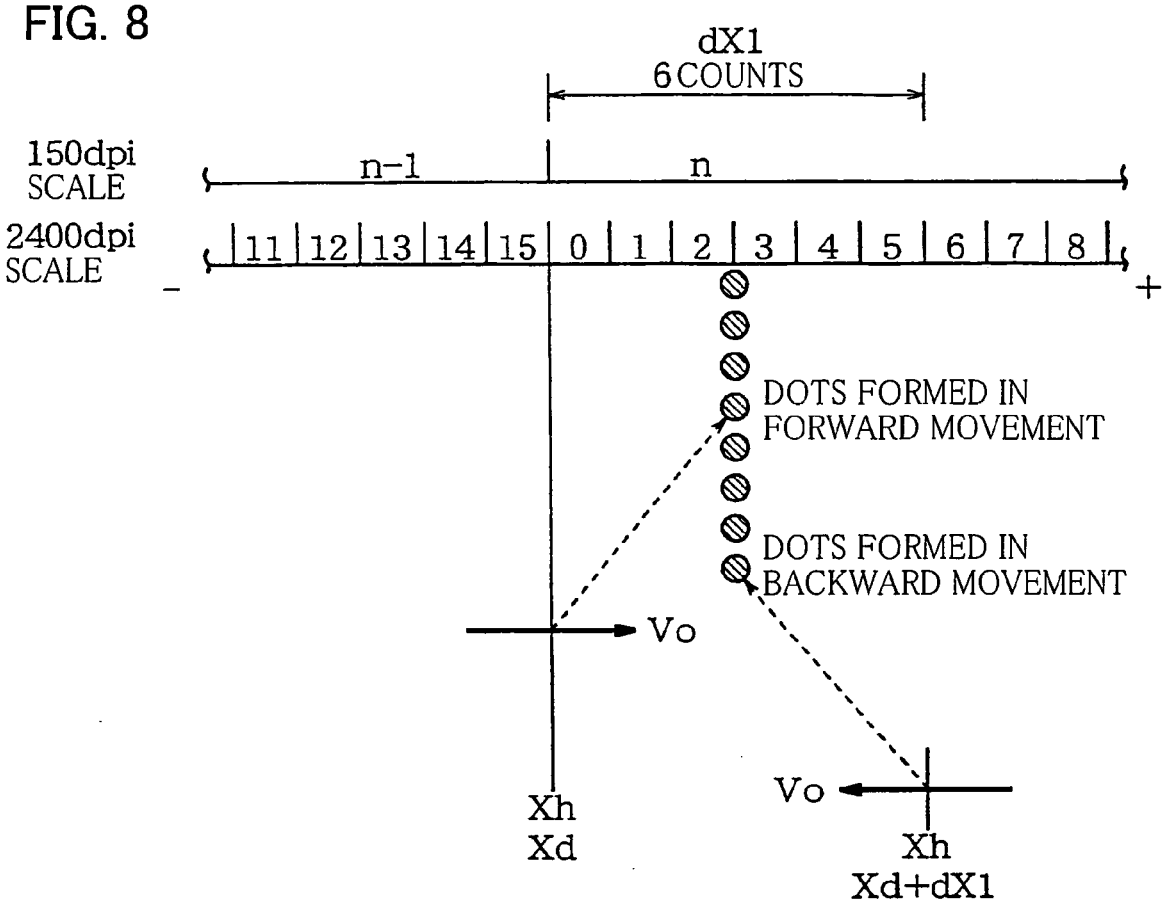
FIG. 8 is a drawing illustrating matching of the dots formed in the forward movement and the dots formed in the return movement after correction in the return movement only.

FIG. 8 illustrates control based on the double-direction reference correction quantity dX1. In this case, the positional correction quantity is made 0 for the control either in the forward movement or in the return movement so that the dot formed in the forward movement and the dot formed in the return movement for identical dot position Xd hits the paper (P) at the identical positions. In the movement in the other direction, the control is done based on the double-direction reference correction quantity dX1.

FIG. 8 shows when the speed is V0 in the forward movement and the return movement. Under these conditions, in the forward movement, ink is ejected corresponding to an identical dot position on the image (=Xh) to the position Xh at the ink eject position Xh. In the return movement, ink is ejected corresponding to a dot position on the image (=Xh−dX1) which is more negative than the position Xh by the double-direction reference correction quantity dX1 at the ink eject position Xh. As a result, as shown in FIG. 8, with respect to the identical dot positions Xd on the image, ink is ejected at the ink eject position Xh (=Xd) which is identical to the dot position Xd in the forward movement and at the ink eject position Xh (=Xd+dX1) which is more positive than the dot position Xd by the double-direction correction quantity X1 in the return movement. A control may be done based on the double-direction reference correction quantity dX1 in the forward movement and with a zero positional correction quantity in the return movement.

The double-direction discrepancy is substantially proportional to the carriage speed. Therefore, if the carriage speed is not equal to the reference speed V0, a double-direction correction quantity dX(t) is calculated as given by equation (2) from the reference speed V0, the double-direction reference correction quantity dX1, and the sensed carriage speed V(t). A similar ink ejection control is possible based on this double-direction correction quantity dX(t).

$$dX(t)=dX1\times V(t)/V0 \quad (2)$$

The double-direction positional correction quantity is also obtainable from a sensed carriage speed in reference to a correction quantity table prepared in advance. The table contains double-direction positional correction quantities at given carriage speeds. The table can be created through proportionality computation on the double-direction reference correction quantity dX1 at the reference speed V0.

The carriage speed is sensed from the output of the encoder (22). The cycle of the pulse signal output of the encoder (22) (hereinafter, "output pulse cycle") is inversely proportional to the carriage speed. Therefore, the single-direction reference correction quantity dX0 or the double-direction reference correction quantity dX1 for the encoder output pulse cycle (reference pulse cycle) T0 at the reference speed V0 is prepared in advance. Using these and the sensed encoder output pulse cycle T(t), the single-direction positional correction quantity dX(t) or the double-direction positional correction quantity dX(t) is given by equation (3).

$$dX(t)=dX0\times T0/T(t) \quad (3)$$

$$dX(t)=dX1\times T0/T(t) \quad (4)$$

The single-direction positional correction quantity (or double-direction reference correction quantity) is also obtainable from an encoder output pulse cycle at the sensed carriage speed in reference to a correction quantity table prepared in advance. The table contains single-direction positional correction quantities (or double-direction positional correction quantities) for the encoder output pulse cycle at given carriage speeds. The table can be created through proportionality computation on the single-direction reference correction quantity dX0 (or double-direction reference correction quantity dX1) for the reference pulse cycle T0 at the reference speed V0.

Next, referring to FIG. 9 to FIG. 14, will be described an example of steps of determining a single-direction positional correction quantity from an encoder output pulse cycle and controlling ink ejection based on the single-direction positional correction quantity.

Figure 9:
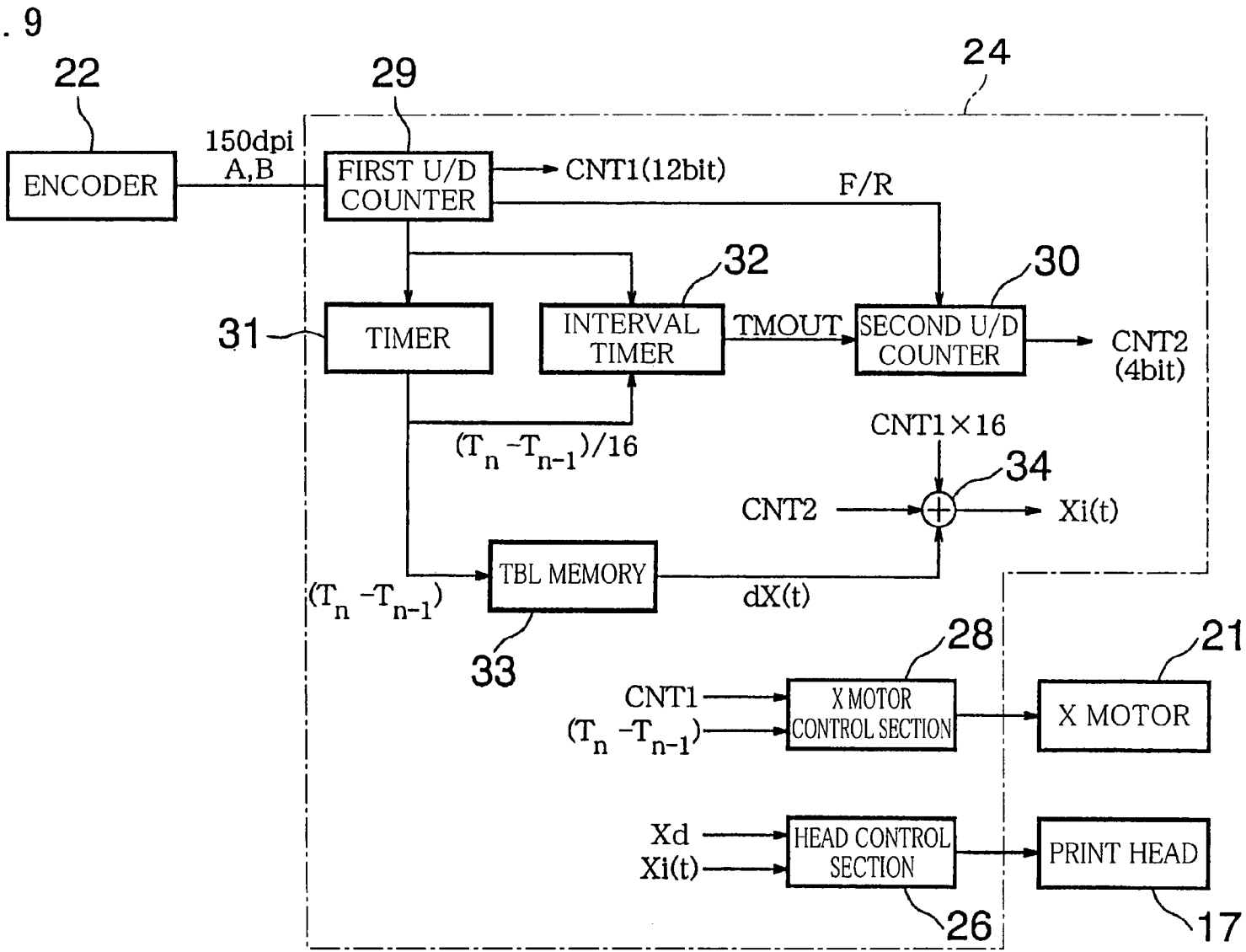
FIG. 9 is a functional block diagram showing, as an example, the functions and arrangement of a control section related to ink ejection control.

FIG. 9 shows functions and arrangement of a part of the control section (24) related to the control.

In FIG. 9, an X motor control section (28) is a part of the drive system control section (25) in FIG. 3 which controls the X motor (21). The control section (24) includes a first U/D (up/down) counter (29), a second U/D counter (30), a timer (31), an interval timer (32), a TBL memory (33), and an adder (34).

Figure 10:
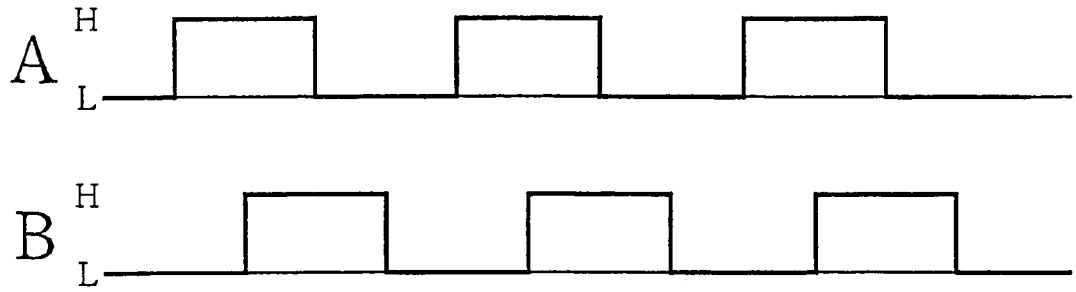
FIG. 10 is time charts showing exemplary encoder output signals.

The encoder (22) outputs two 150-dpi pulse signals A and B shown in FIG. 10 as a result of the movement of the carriage (15). The two signals A and B are out of phase from each other by a quarter cycle. In a forward movement, the signals A and B changes left to right in FIG. 10. In a return movement, the signals A and B changes right to left in FIG. 10.

The first U/D counter (29) counts the pulses of the signal A from the encoder (22) to obtain first position information CNT1 which is nothing but the count. The resolution of the first position information CNT1 is 150 dpi. He first position information CNT1 is 12 bits, and its maximum value is equivalent to 693 mm. The first U/D counter (29) determines, from the output signals A, B from the encoder (22), whether the carriage (15) is moving in the forward direction or in the return direction and outputs a signal F/R indicating either the forward movement or the return movement to the second U/D counter (30).

The timer (31) measures time by counting predetermined clock pulses. By calculating a difference between a time-measure count $T_n$ when the signal A rises and a time-measure count $T_{n-1}$ when the signal A rose last time, the pulse cycle T(t) ($=T_n-T_{n-1}$) of the current signal A is determined which is then output to the TBL memory (33). In addition, the count of the pulse cycle T(t) right-shifted by 4 bits to divided it by 16 for output to the interval timer (32).

The interval timer (32) measures time by counting the same clock pulses as the timer (31). Every time the time-measure count reaches the encoder output pulse cycle T(t) divided by 16 (=T(t)/16), the interval timer (32) outputs a timeout signal TMOUT to the second U/D counter (30).

The second U/D counter (30) counts timeout signals TMOUT from the interval timer (32) to obtain second position information CNT2 which is nothing but the count. The second position information CNT2 is 4 bits, and the value is from 0 to 15. As would be obvious from the description, the timeout signal TMOUT is output at a cycle of the encoder output pulse cycle T(t) divided by 16. Therefore, the resolution of the second position information CNT2 is 2400 dpi, or 1/16 times the resolution (150 dpi) of the first position information CNT1.

The TBL memory (33) stores the reference encoder output pulse cycle T0 and the single-direction reference positional correction quantity dX0 at the reference speed V0 of the carriage (15). The positional correction quantity dX(t) is calculated from these and the encoder output pulse cycle T(t) from the timer (31) using equation (3).

The adder (33) adds a value 16 times the first position information CNT1, the second position information CNT2, and the positional correction quantity dX(t) to obtain a corrected position Xi(t). The sum CNT (=CNT1×16+CNT2) of 16 times the first position information CNT1 and the second position information CNT2 represents the current position X(t) of the carriage (15) at a resolution of 2400 dpi. Therefore, the corrected position Xi(t), or the sum of the current position X(t) and the positional correction quantity dX(t), represents a dot position on the image which is hit by ink ejected at the current carriage position X(t).

The X motor control section (28) receives the first position information CNT1 and the encoder output pulse cycle T(t). Based on these inputs, the X motor control section (28) controls the X motor (21) to control the movement of the carriage (15).

The head control section (28) receives the corrected position Xi(t) and the dot position Xd on the image from the adder (33). When the corrected position Xi(t) matches the dot position Xd on the image, the head control section (26) ejects ink in a manner corresponding to the dot position Xd.

The encoder (22) and the first U/D counter (29) form position sensing means for the carriage (15). The encoder (22), the first U/D counter (29), and the timer (31) form speed sensing means for the carriage (15). The first U/D counter (29) forms approximate position sensing means for the carriage (15). The second U/D counter (30) and the interval timer (32) form position details sensing means for the carriage (15). The timer (31) forms time measurement means. The TBL memory (33) forms correction quantity determining means. The head control section (26) forms ejection control means.

Next, referring to flow charts in FIG. 11 to FIG. 14 will an example of processes be described.

Figure 11:
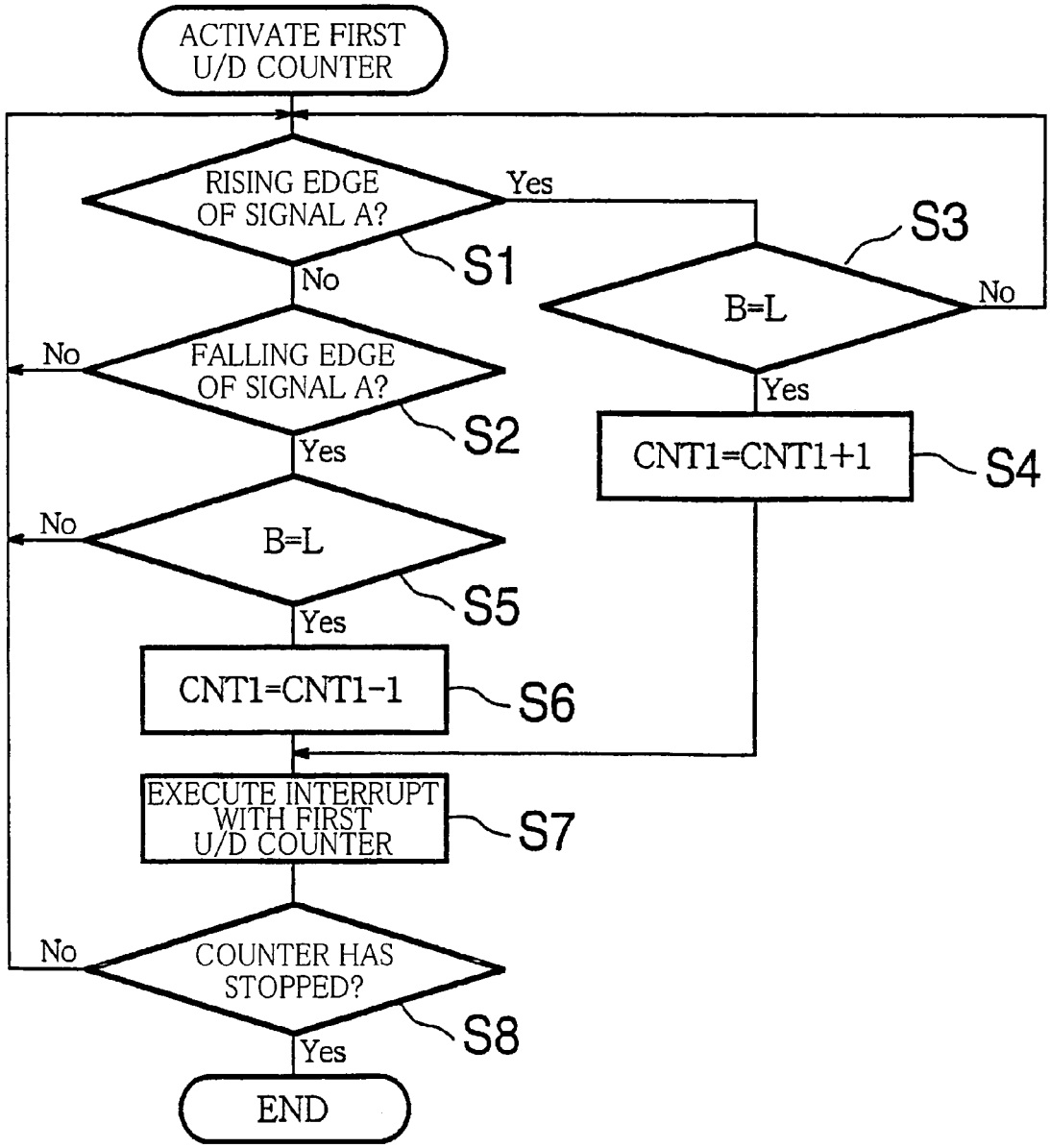
FIG. 11 is a flow chart showing, as an example, a process by a first U/D counter.

FIG. 11 shows an example of a count process of the first position information by the first U/D counter (29).

In FIG. 11, as the first U/D counter (29) is activated, first, an edge is examined as to whether it is a rising edge of the signal A (S1). If not, it is examined as to whether it is a falling edge of the signal A (S2). If not, the process returns to S1. If it is a rising edge of the signal A in S1, it is examined as to whether the signal B is L (low level) (S3). If not, the process returns to S1. If the signal B is L in S3, 1 is added to the first position information CNT1 (S4).

In contrast, if it is a falling edge of the signal A in S2, it is examined whether the signal B is L (S5). If not, the process returns to S1. If the signal B is L in S5, 1 is subtracted from the first position information CNT1 (S6).

After the completion of S4 or S6, an interrupt process is executed by the first U/D counter (29) in the timer (31) (detailed later) (S7). Then, it is examined as to whether the counter has stopped (S8). If not, the process returns to S1. If so, the process ends.

In a forward movement, as would be obvious from FIG. 10, the signal B is H (high level) at a falling edge of the signal A. Therefore, even if the process goes from S1 and S2 to S5, it does not return to S1 and continue at S6. In addition, at a rising edge of the signal A, the signal B is L. Therefore, when the process goes from S1 to S3, it goes on to S4 where 1 is added to the first position information CNT1. Then, every time a rising edge of the signal A is sensed, the first position information CNT1 is incremented by 1. This corresponds to the carriage (15) moving toward the positive side of the x axis in the forward movement.

In a return movement, as would be obvious from FIG. 10, the signal B is H (high level) at a rising edge of signal A. Therefore, even if the process goes from S1 to S3, it does not return to S1 and continue at S4. In addition, at a falling edge of the signal A, the signal B is L. Therefore, when the process goes from S1 and S2 to S5, it goes on to S6 where 1 is subtracted to the first position information CNT1. Then, every time a falling edge of the signal A is sensed, the first position information CNT1 is decremented by 1. This corresponds to the carriage (15) moving toward the negative side of the x axis in the return movement.

Figure 12:
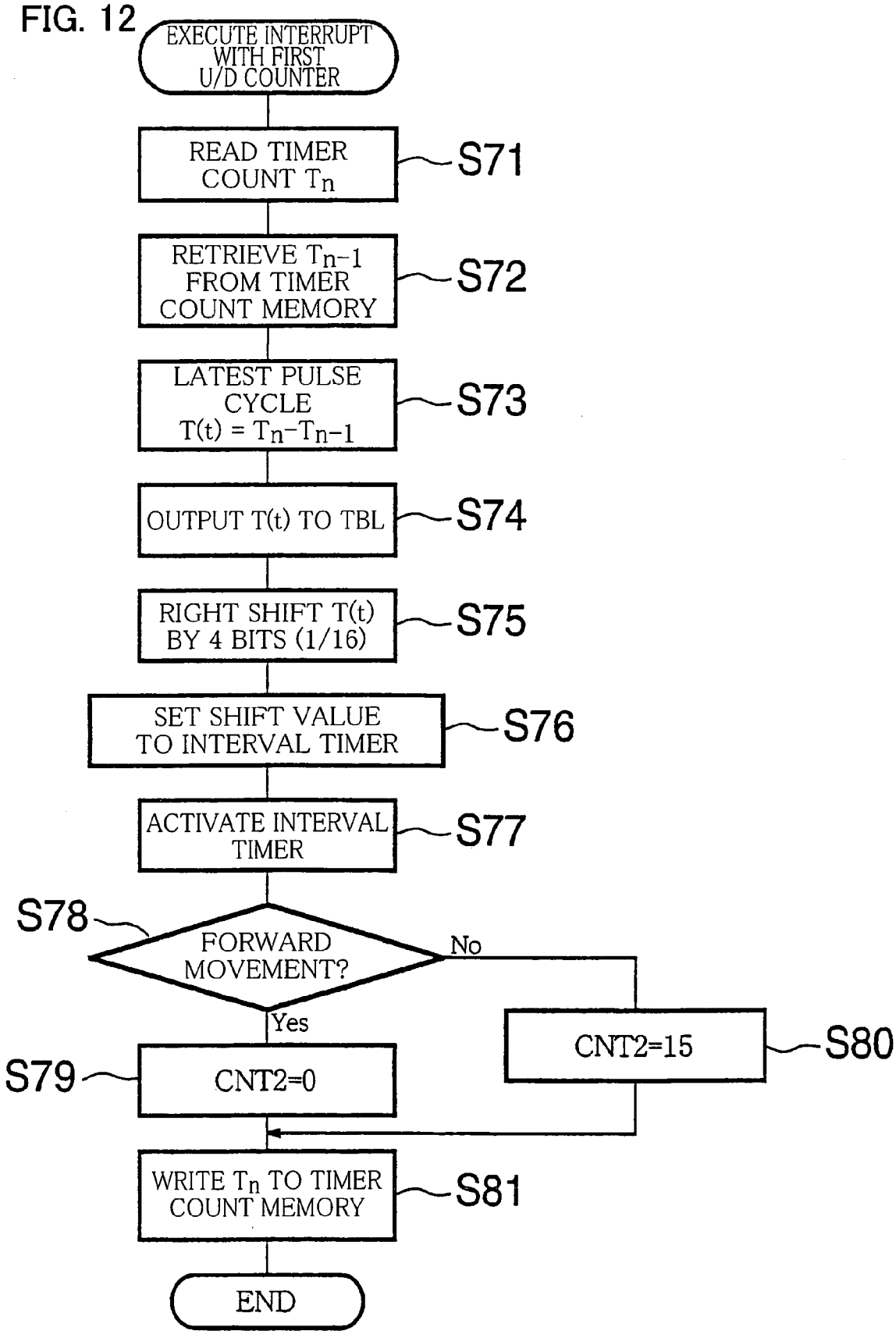
FIG. 12 is a flow chart showing, as an example, an interrupt process by the first U/D counter on a timer.

FIG. 12 shows an example of the interrupt process in S7 in FIG. 11.

In FIG. 12, first, the time-measure count (timer value) $T_n$ of the timer (31) is read (S71), and the last time measurement reading $T_{n-1}$ is retrieved from a built-in timer value memory (S72). Then, from these, a latest pulse cycle T(t) ($=T_n-T_{n-1}$) is calculated (S73) which is output to the TBL memory (33) (S74). Next, the count of the pulse cycle T(t) is right-shifted by 4 bits to divide it by 16 (S75). The interval timer (32) is set to the result (S76), and the interval timer (32) is activated (S77).

Then, it is determined whether the carriage (15) is in a forward movement (S78). If so, the second position information CNT2 is set to 0 (S79). If not, the second position information CNT2 is set to 15 (S80). After the completion of S79 or S80, the reading of the time-measure count $T_n$ obtained in S71 is written to a timer value memory (S81) before the process ends.

Figure 13:
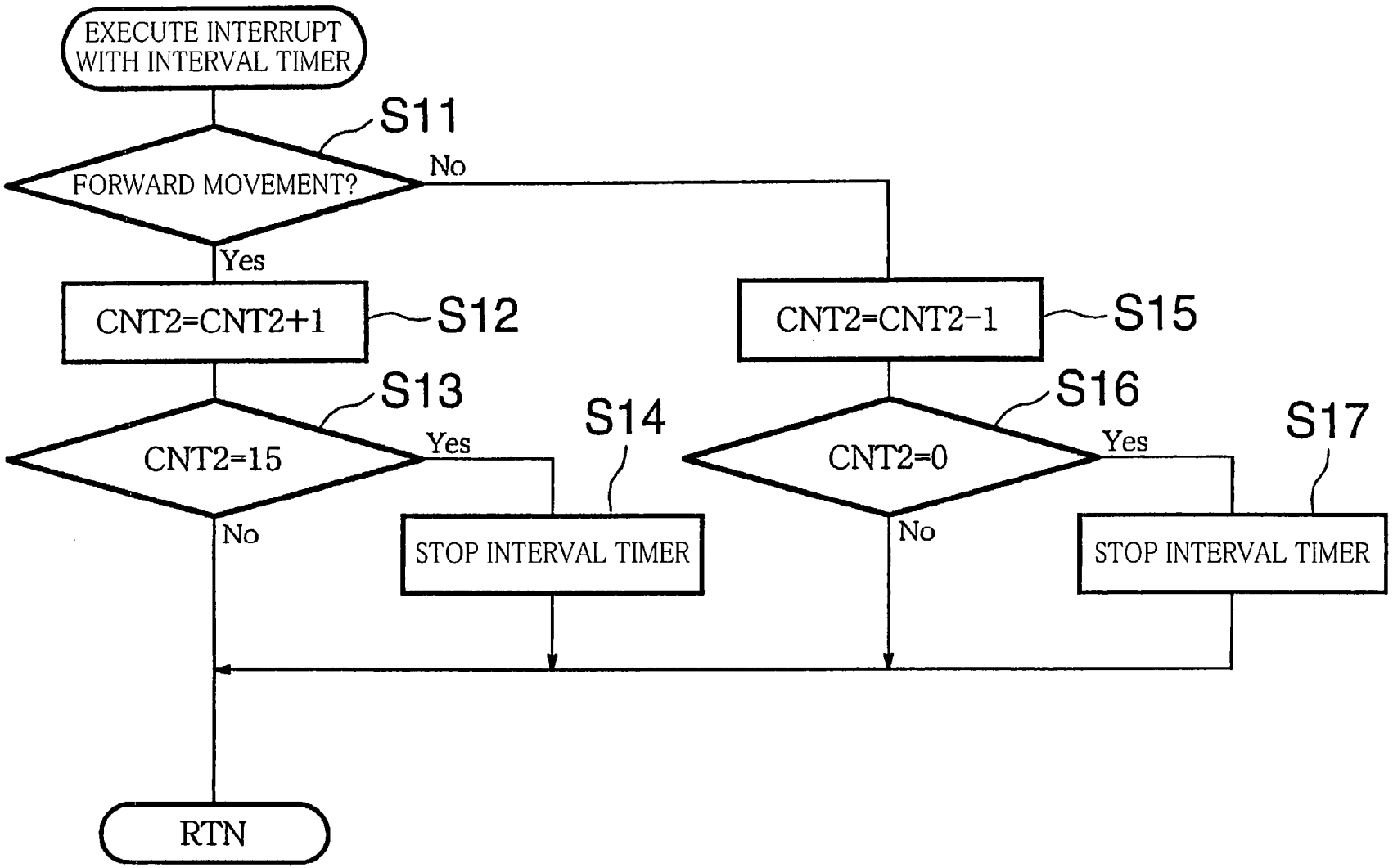
FIG. 13 is a flow chart showing, as an example, an interrupt process by an interval timer on a second U/D counter.

FIG. 13 shows an example of the interrupt process by the interval timer (32) in the second U/D counter (30). The process is executed every time the interval timer (32) outputs a timeout signal TMOUT.

In FIG. 13, first, it is determined whether the carriage (15) is in a forward movement (S11). If so, 1 is added to the second position information CNT2 (S12). Thereafter, it is determined whether the second position information CNT2 is 15 (S13). If not, the process ends. If the second position information CNT2 is 15 in S13, the interval timer (32) is stopped (S14) before the process ends.

In contrast, if the carriage (15) is in a return movement in S11, 1 is subtracted from the second position information CNT2 (S15). Thereafter, it is determined whether the second position information CNT2 is 0 (S16). If not, the process ends. If the second position information CNT2 is 0 in S16, the interval timer (32) is stopped (S17) before the process ends.

In a forward movement, the second position information CNT2 is set to 0 in S79 in the flow chart in FIG. 12. For this reason, until the flow chart in FIG. 12 is executed next time, in other words, until a next rising edge of the signal A, S12 in the flow chart in FIG. 13 is executed 15 times to increment the second position information CNT2 from 0 to 15 by 1.

In a return movement, the second position information CNT2 is set to 15 in S80 in the flow chart in FIG. 12. For this reason, until the flow chart in FIG. 12 is executed next time, in other words, until a next falling edge of the signal A, S15 in the flow chart in FIG. 13 is executed 15 times to decrement the second position information CNT2 from 15 to 0 by 1.

Therefore, both in the forward movement and in the return movement, the 2400 dpi position information of the carriage (15) is obtained by adding the first position information CNT1 multiplied by 16 to the second position information CNT2.

Figure 14:
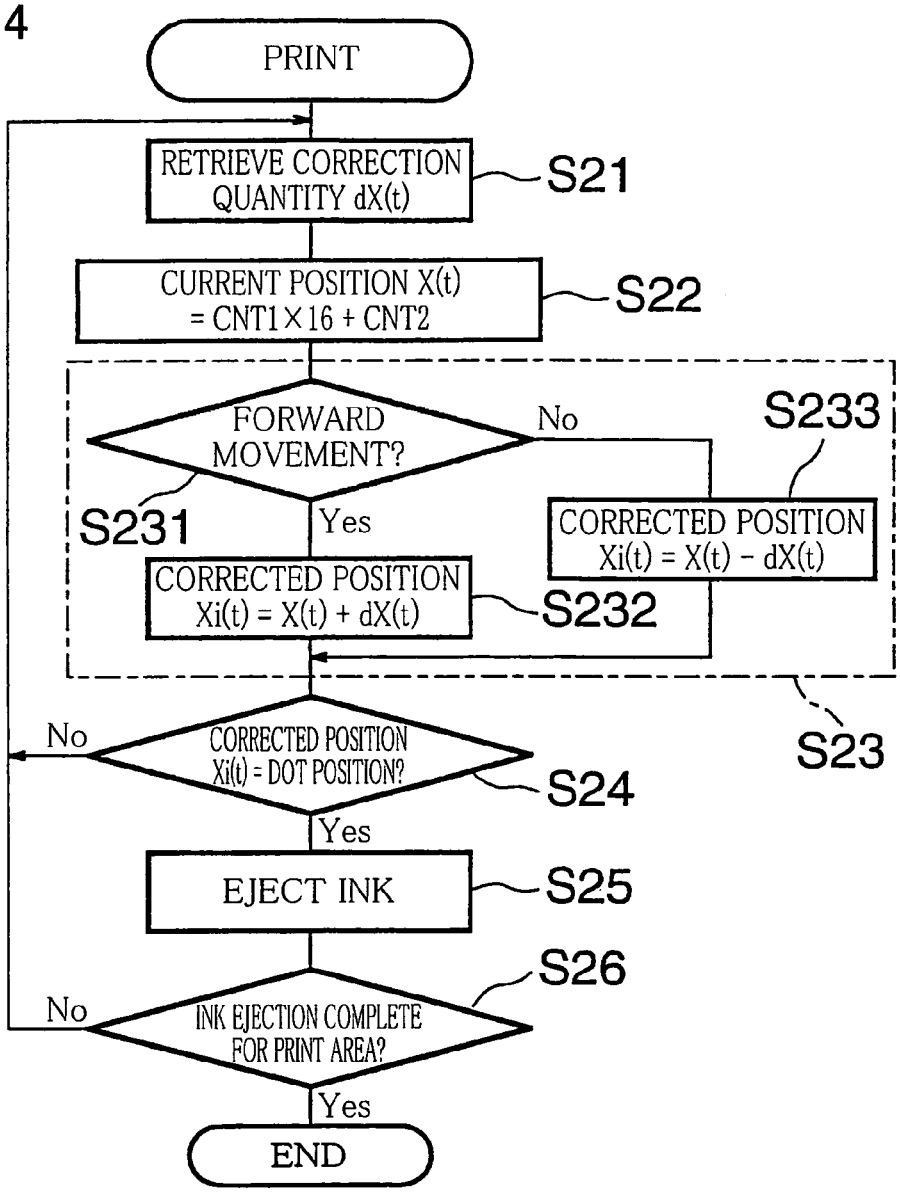
FIG. 14 is a flow chart showing, as an example, a corrected position computing process and an ink ejection control process.

FIG. 14 shows an example of a process by the adder (34) and another process by the head control section (26).

In FIG. 14, first, the positional correction quantity dX(t) is retrieved from the TBL memory (33) (S21). The current position X(t) of the carriage (15) is computed as given by equation (9) (S22).

$$X(t)=CNT1\times 16+CNT2 \tag{9}$$

Next, a corrected position computing step (S23) is executed. In other words, first, it is determined whether the carriage (15) is in a forward movement (S231). If so, the positional correction quantity dX(t) is added to the current position X(t) to obtain the corrected position Xi(t) (S232). If it is determined in S231 that the carriage (15) is in a return movement (S231), the positional correction quantity dX(t) is subtracted from the current position X(t) to obtain the corrected position Xi(t) (S233).

After the completion of the corrected position computing step in S23, it is determined whether the corrected position Xi(t) matches the dot position Xd on the image (S24). If not, the process returns to S21. If the corrected position Xi(t) match the dot position Xd in S24, ink is ejected corresponding to the dot position Xd (S25). Then, it is determined whether ink ejection (print) for the print area is complete (S26). If not, the process returns to S21. If so, the process ends.

When the ink ejection control is done based on the double-direction positional correction quantity obtained from the encoder output pulse cycle, the TBL memory (33) holds the reference encoder output pulse cycle T0 and the double-direction reference positional correction quantity dX1 when the carriage (15) is moving a the reference speed V0. From these and the encoder output pulse cycle T(t) from the timer (31), the positional correction quantity dX(t) can be given by equation (4). In addition, in the flow chart in FIG. 14, the corrected position computing step of S23 is replaced by the step in FIG. 15.

Figure 15:
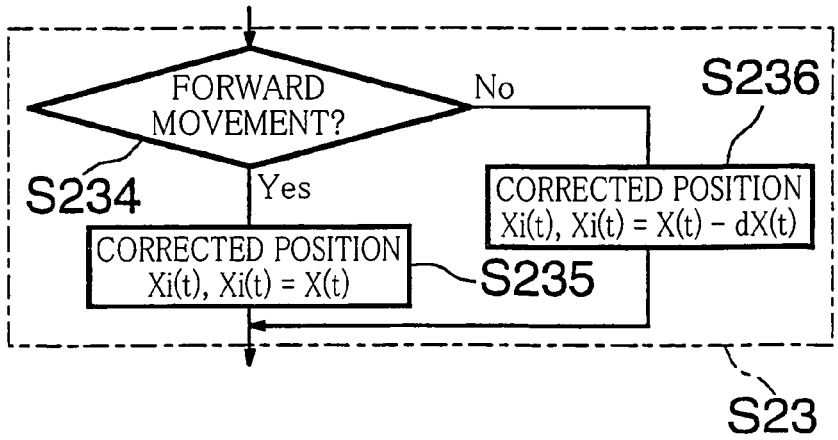
FIG. 15 is a flow chart showing, as an example, changes in the ink ejection control process in FIG. 14.

In FIG. 15, first, it is determined whether the carriage (15) is moving in a forward movement (S234). If so, the current position X(t) is set to the corrected position Xi(t) (S235). In S234, if it is determined that the carriage (15) is moving in a return movement, the positional correction quantity dX(t) is subtracted from the current position X(t) to obtain the corrected position Xi(t) (S236).

Otherwise, the same ink ejection control based on the single-direction positional correction quantity is implemented.

In the example, to represent the position of the carriage (15), position information is applied to the two sets of information, i.e. the first position information CNT1 (150 dpi) and the second position information CNT2 (2400 dpi). A single set of position information made up of the first position information and the second position information appended as lower order digits to the first position information can represent the position of the carriage (15).

Figure 16:
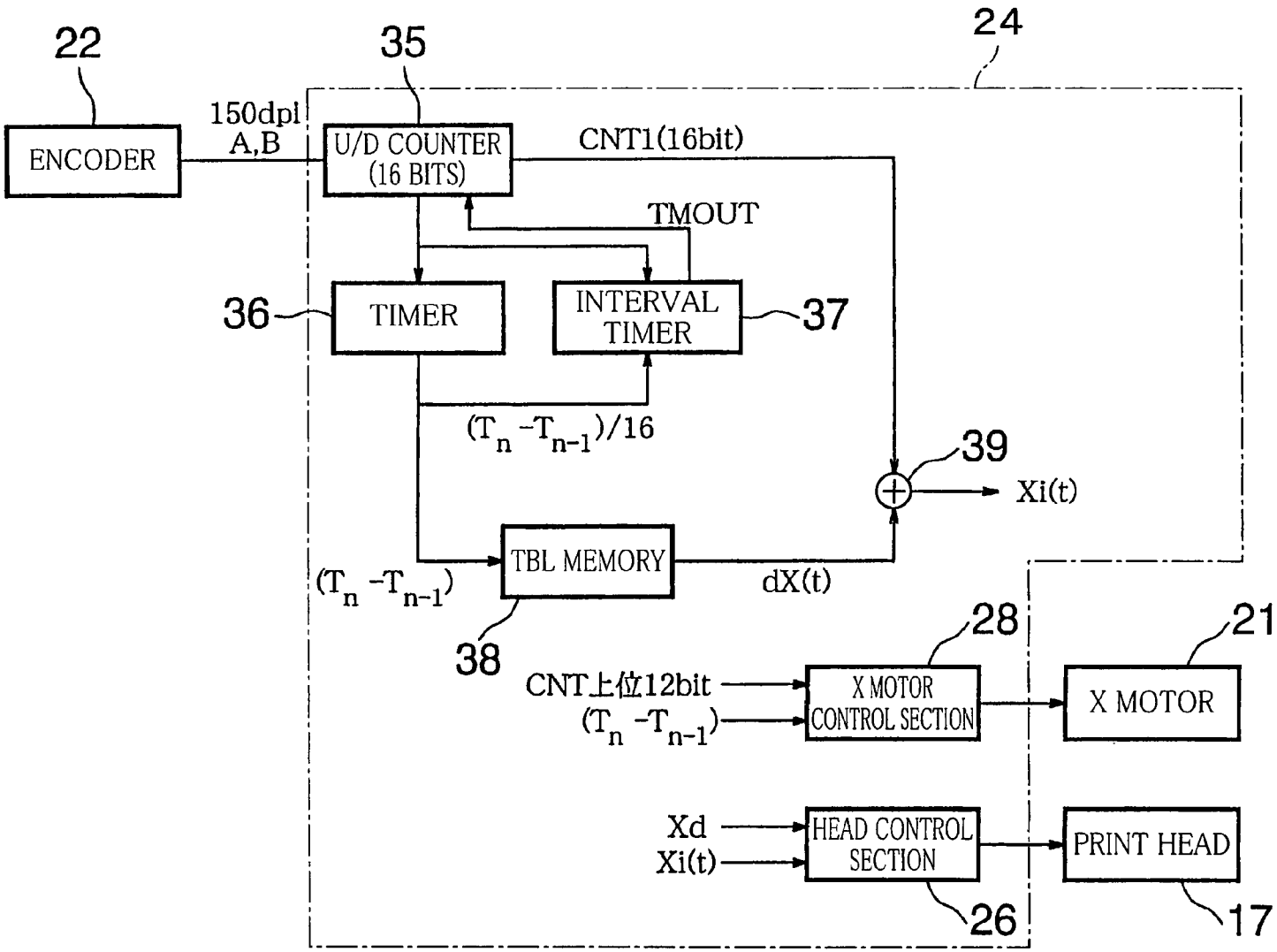
FIG. 16 is a functional block diagram showing, as another example, the functions and arrangement of a control section related to ink ejection control.

FIG. 16 shows functions and arrangement the control section (24) which is a part related to the ink ejection control under these conditions. As shown in the figure, the control section (24) includes a U/D counter (35), a timer (36), an interval timer (37), a TBL memory (38), and an adder (39).

The timer (36) and the TBL memory (38) are arranged similarly to the timer (31) and the TBL memory (33) in FIG. 9. In addition, the interval timer (37) operates similarly to the interval timer (32) in FIG. 9, but differs from it where the timeout signal TMOUT, or an output signal, is fed to the U/D counter (35).

The U/D counter (35) is a 16 bit counter. The counter (35) counts the output pulses from the encoder (22) using the higher order 12 bits (first position information) and timeout signals TMOUT from the interval timer (37) using the lower order 4 bits (second position information), so as to obtain 2400 dpi position information CNT. The position information CNT represents nothing but the current position X(t) of the carriage (15).

The adder (39) determines a corrected position Xi(t) by adding the position information CNT which represents the current position X(t) of the carriage (15) and the positional correction quantity dX(t) obtained by the TBL memory (38).

The X motor control section (28) receives the higher order 12 bits of the position information CNT and the encoder output pulse cycle T(t). On the basis of these, the X motor control section (28) controls the X motor (21) to controls the movement of the carriage (15).

The encoder (22) and the U/D counter (35) form the position sensing means for the carriage (15). The encoder (22), the U/D counter (35), and the timer (36) form the speed sensing means for the carriage (15). The U/D counter (35) forms the approximate position sensing means for the carriage (15). The U/D counter (35) and the interval timer (37) form the position details sensing means for the carriage (15). The timer (36) forms the time measurement means. The TBL memory (38) forms the correction quantity determining means. The head control section (26) forms the ejection control means.

Figure 17:
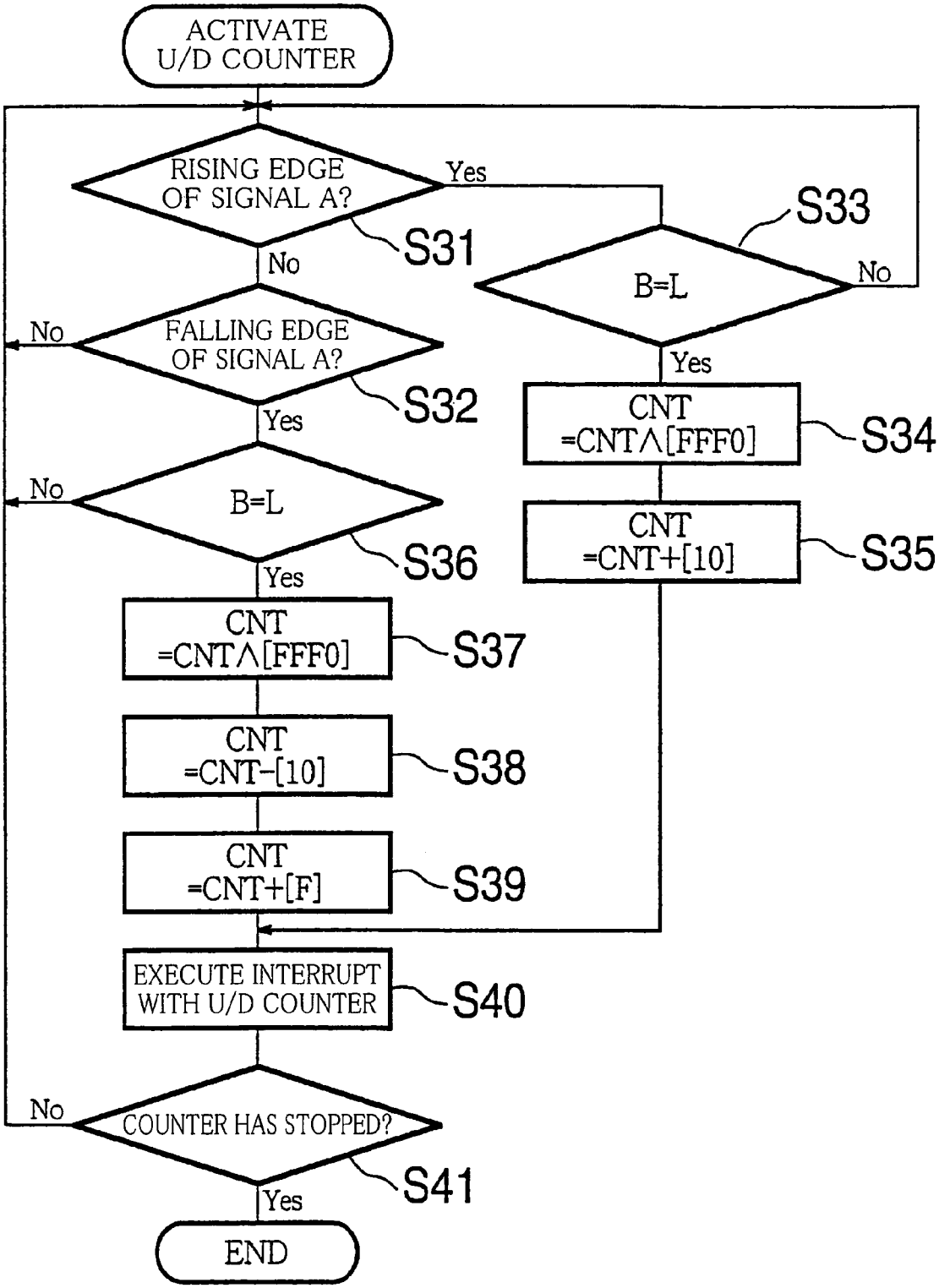
FIG. 17 is a flow chart showing, as an example, a process by a U/D counter.

FIG. 17 shows an example of a count process by the U/D counter (35) using the higher order 12 bits.

In FIG. 17, as the U/D counter (35) is activated, first, an edge is examined whether it is a rising edge of the signal A (S31). If not, it is examined whether it is a falling edge of the signal A (S32). If not, the process returns to S31. If it is a rising edge of the signal A in S31, it is examined whether the signal B is L (low level) (S33). If not, the process returns to S31. If the signal B is L in S33, the position information CNT is set to the AND (AND) of the position information CNT at that time and [FFF0] (S34), and the [10] is added to the position information CNT (S35).

In contrast, if it is a falling edge of the signal A in S32, it is examined whether the signal B is L (S36). If not, the process returns to S31. If the signal B is L in S36, the position information CNT is set to the AND of the position information CNT and [FFF0] (S37), [10] is subtracted from the position information CNT (S38), and [F] is added to the position information CNT (S39).

After the completion of S35 or S39, an interrupt process by the U/D counter (35) in the timer (36) is implemented (S40). This is the same interrupt process as the one in S7 in the flow chart in FIG. 11. Then, it is examined whether the counter has stopped (S40). If not, the process returns to S31. If so, the process ends.

In a forward movement, as explained earlier, every time a rising edge of the signal A from the encoder (22) is sensed, the higher order 12 bits of the position information CNT is incremented by 1. In addition, when the process in the flow chart in FIG. 17 ends, the lower order 4 bits of the position information CNT is 0. Every time a timeout signal TMOUT is fed from the interval timer (37), the lower order 4 bits of the position information CNT is incremented by 1. Since the timeout signal TMOUT is fed 15 times before a next rising edge of the signal A is sensed, the lower order 4 bits of the position information CNT is incremented from 1 to 15. As a result, the entire position information CNT is incremented by 1 on each input of a timeout signal TMOUT. This corresponds to the carriage (15) moving toward the positive side of the x axis in the forward movement.

In a return movement, as explained earlier, every time a falling edge of the signal A from the encoder (22) is sensed, the higher order 12 bits of the position information CNT is decremented by 1. In addition, when the process in the flow chart in FIG. 17 ends, the lower order 4 bits of the position information CNT is 15. Every time a timeout signal TMOUT from the interval timer (37) is fed, the lower order 4 bits of the position information CNT is decremented by 1. Since the timeout signal TMOUT is fed 15 times before a next falling edge of the signal A is sensed, the lower order 4 bits of the position information CNT is decremented from 15 to 0. As a result, the entire position information CNT is decremented by 1 on each input of a timeout signal TMOUT. This corresponds to the carriage (15) moving toward the negative side of the x axis in the return movement.

In the embodiment, the present invention has been applied to inkjet printers which prints on paper. Alternatively, the present invention is applicable to any given device utilizing inkjet technology, including manufacturing steps for color filters in liquid crystal panels, organic EL panels, light switch elements, printed wiring boards, and electronic circuits.

In addition, the members and process steps related to the control section (24) in the inkjet print device of the embodiment can be realized by a CPU or other compute means executing computer programs contained in a ROM, RAM, or other storage means to control periphery devices. Therefore, a computer equipped with these means can realize various functions and processes related to the control section (24) in the inkjet print device of the present embodiment merely by reading a storage medium containing the computer program and executing the computer program. In addition, if the computer program is contained in a removable storage medium, the various functions and processes can be realized on any given computer.

Such a computer program storage medium may be a memory (not shown), such as a ROM, so that the process is executable on a microcomputer. Alternatively, a program medium may be used which can be read by inserting the storage medium in an external storage device (program reader device; not shown).

In addition, in either of the cases, it is preferable if the contained program is accessible to a microprocessor which will execute the program. Further, it is preferable if the program is read, and the program is then downloaded to a program storage area of a microcomputer where the program is executed. Assume that the program for download is stored in a main body device in advance.

In addition, the program medium is a storage medium arranged so that it can be separated from the main body. Examples of such a program medium include a tape, such as a magnetic tape and a cassette tape; a magnetic disk, such as a flexible disk and a hard disk; a disc, such as a CD/MO/MD/DVD; a card, such as an IC card (inclusive of a memory card); and a semiconductor memory, such as a mask ROM, an EPROM (erasable programmable read only memory), an EEPROM (electrically erasable programmable read only memory), or a flash ROM. All these storage media hold a program in a fixed manner.

Alternatively, if a system can be constructed which can connects to the Internet or other communications network, it is preferable if the program medium is a storage medium carrying the program in a flowing manner as in the downloading of a program over the communications network.

Further, when the program is downloaded over a communications network in this manner, it is preferable if the program for download is stored in a main body device in advance or installed from another storage medium.

As in the foregoing, an inkjet print device in accordance with the present invention is arranged to include: position sensing means for sensing the carriage position; speed sensing means for sensing moving speed of the carriage; correction quantity determining means for presetting a relationship between the carriage speed and a positional correction quantity for correcting a discrepancy in an ink hitting position resulting from the ink ejection from the print head while the carriage is moving and for determining the positional correction quantity from the carriage speed sensed by the speed sensing means according to the preset relationship; and ejection control means for controlling the ink ejection from the print head according to the positional correction quantity determined by the correction quantity determining means and the carriage position sensed by the position sensing means.

It is desirable if the correction quantity determining means is activated at least when the carriage is either accelerating or decelerating.

Thus, even if the carriage speed changes, the ink ejection from the print head is controlled with a suitable positional correction quantity. Thus, good image quality is available even while the carriage is accelerating or decelerating. Hence, the device can print in the accelerate/decelerate areas flanking the constant-speed area, achieving reduced print time and reduced device size.

The positional correction quantity may be a difference of the ink hitting position from a position of the ink ejection from the print head. When this is the case, the positional correction quantity substantially proportional to the carriage speed. Therefore, simple proportionality computation can achieve a suitable positional correction quantity (detailed later).

In addition, the positional correction quantity may be a difference between an ink hitting position in the forward movement and an ink hitting position in the return movement related to a certain ink eject position of the print head. When this is the case, the positional correction quantity is substantially proportional to the carriage speed. Therefore, simple proportionality computation can achieve a suitable positional correction quantity (detailed later).

Further, when this is the case, the ejection control means controls ink ejection with the positional correction quantity being 0 in either one of the forward movement and the return movement. In other words, the ink eject position does not need to be corrected in either one of the forward movement and the return movement.

Another inkjet print device in accordance with the present invention is arranged as in the foregoing, and characterized in that the relationship between the carriage speed and the positional correction quantity is a proportional relationship.

According to the arrangement, a certain carriage speed is designated as a reference carriage speed, and a positional correction quantity at the reference carriage speed is designated as a reference positional correction quantity. With the reference carriage speed and the reference positional correction quantity being prestored, proportionality computation can determine the positional correction quantity from the carriage speed sensed by the speed sensing means. Therefore, simple proportionality computation can achieve a suitable positional correction quantity.

Another inkjet print device in accordance with the present invention is arranged as in the foregoing, and characterized in that the correction quantity determining means prestores a certain carriage speed and a positional correction quantity at that carriage speed as a respective reference carriage speed V0 and also prestores a reference positional correction quantity dX0 and determines the positional correction quantity dX(t) from the moving speed V(t) of the carriage sensed by the speed sensing means as given by equation (1):

$$dX(t)=dX0\times V(t)/V0 \quad (1)$$

For example, the difference of the ink hitting position from an ink eject position of the print head is designated as a positional correction quantity. An ink eject position at a reference carriage speed V0 is Xh. An ink hitting position is Xp. The reference positional correction quantity dX0 is then given by equation (5):

$$dX0=Xp-Xh \quad (5)$$

In addition, the ink eject position at a carriage speed V(t) sensed by the speed sensing means is Xh(t). An ink hitting position is Xp(t). The positional correction quantity dX(t) is then given by equation (6):

$$dX(t)=Xp(t)-Xh(t) \quad (6)$$

As explained earlier, the positional correction quantity dX(t) at a given carriage speed V(t) is substantially proportional to the carriage speed V(t). Therefore, the positional correction quantity dX(t) is given by equation (1). Thus, the positional correction quantity can be determined by a simple equation.

When the difference of the ink hitting position from an ink eject position of the print head is a positional correction quantity, ink ejection is controlled according to the positional correction quantity determined as above both in the forward movement and in the return movement.

In addition, for example, a difference between an ink hitting position in the forward movement and an ink hitting position in the return movement related to a certain ink eject position of the print head is a positional correction quantity. An ink eject position at the reference carriage speed V0 is Xh. An ink hitting position in the forward movement is Xf. An ink hitting position in the return movement is Xr. The reference positional correction quantity dX1 is then given by equation (7):

$$dX1=Xf-Xr \quad (7)$$

In addition, an ink eject position at the carriage speed V(t) sensed by the speed sensing means is Xh(t). An ink hitting position in the forward movement is Xf(t). An ink hitting position in the return movement is Xr(t). The positional correction quantity dX(t) is given by equation (8):

$$dX(t)=Xf(t)-Xr(t) \quad (8)$$

This is a sum of a difference of the ink hitting position Xf(t) in the forward movement from the ink eject position Xh(t) and a difference of the ink hitting position Xr(t) in the return movement from the ink eject position Xh(t), and therefore is substantially proportional to the carriage speed V(t). Therefore, the positional correction quantity dX(t) can be determined by substituting dX1 for dX0 in equation (1). Thus, the positional correction quantity can be determined by a simple equation.

When the difference between the ink hitting position in the forward movement and the ink hitting position in the return movement related to the certain ink eject position of the print head is a positional correction quantity, the positional correction quantity is rendered 0 and the ink eject position does no need to be corrected in either one of the forward movement and the return movement.

Therefore, according to the arrangement, a suitable positional correction quantity can be achieved through simple equation (1).

Another inkjet print device in accordance with the present invention is arranged as in the foregoing, and characterized in that the correction quantity determining means prestores a correction quantity table representing a relationship between multiple carriage speeds and multiple positional correction quantities and determines the positional correction quantity from the carriage speed sensed by the speed sensing means in reference to the correction quantity table.

The correction quantity table is created, for example, from a positional correction quantity at a certain carriage speed by proportionality computation.

According to the arrangement, a suitable positional correction quantity can be readily achieved using the correction quantity table.

Another inkjet print device in accordance with the present invention is arranged as in the foregoing, and characterized in that the position sensing means contains an encoder producing a pulse signal output according to a displacement of the carriage; the speed sensing means contains time measurement means for measuring a cycle of the pulse output from the encoder; and the correction quantity determining means presets a relationship between the output pulse cycle and the positional correction quantity and determines the positional correction quantity from the cycle of the pulse output measured by the time measurement means according to the preset relationship.

Here, the time measurement means in the speed sensing means can sense the output pulse cycle of the encoder by, for example, counting predetermined clock pulses. When this is the case, the output pulse cycle can be obtained as a count by the time measurement means.

According to the arrangement, the time measurement means measures an output pulse cycle according to a pulse signal output from the encoder. The correction quantity determining means obtains a suitable positional correction quantity from the output pulse cycle measured by the time measurement means. Therefore, a suitable positional correction quantity can be quickly obtained according to signals from well known devices, such as the timer and the encoder which form the time measurement means. Thus, efficiency in the inkjet print process is improved.

Another inkjet print device in accordance with the present invention is arranged as in the foregoing, and characterized in that the relationship between the output pulse cycle and the positional correction quantity is an inversely proportional relationship.

The output pulse cycle of the encoder is inversely proportional to the carriage speed. Therefore, according to the arrangement, the output pulse cycle is inversely proportional to the positional correction quantity; therefore, similarly to the case where the aforementioned carriage speed is proportional to the positional correction quantity, the certain output pulse cycle designated as is a reference output pulse cycle, and a positional correction quantity at the reference output pulse cycle as a reference positional correction quantity. With these reference output pulse cycle and reference positional correction quantity being prestored, inverse proportionality computation can provide a positional correction quantity from the output pulse cycle sensed by the encoder and the time measurement means. Therefore, simple calculation can determine a suitable positional correction quantity.

Another inkjet print device in accordance with the present invention is arranged as in the foregoing, and characterized in that the correction quantity determining means prestores the output pulse cycle T0 at a certain speed V0 of the carriage and the positional correction quantity dX0 and determines the positional correction quantity dX(t) from the output pulse cycle T(t) measured by the time measurement means in the speed sensing means as given by equation (3):

$$dX(t)=dX0\times T0/T(t) \quad (3)$$

As explained earlier, the positional correction quantity dX(t) at a given carriage speed V(t) is substantially inversely proportional to the output pulse cycle of the encoder T(t). Therefore, the positional correction quantity dX(t) is given by equation (3). Thus, a suitable positional correction quantity can be determined through simple equation (3).

Another inkjet print device in accordance with the present invention is arranged as in the foregoing, and characterized in that the correction quantity determining means prestores a correction quantity table representing a relationship between the multiple output pulse cycles and multiple positional correction quantities and determines the positional correction quantity from the output pulse cycle measured by the time measurement means in the speed sensing means in reference to the correction quantity table.

The correction quantity table can be created, for example, through inverse proportionality computation on the positional correction quantity at a certain output pulse cycle.

According to the arrangement, a suitable positional correction quantity can be readily determined using the correction quantity table.

Another inkjet print device in accordance with the present invention is arranged as in the foregoing, and characterized in that the device further includes position details sensing means for dividing the output pulse cycle time-measured by the time measurement means and counting every time the divided cycle elapses so as to sense position details of the carriage.

According to the arrangement, the output pulse cycle is divided, and every time the divided cycle elapses, counted. Therefore, carriage position details are determined at a higher resolution than the encoder resolution. Controlling the ink ejection according to the position details can achieve high resolution printing.

Assuming, for example, that the encoder resolution is 150 dpi, and the output pulse cycle is divided by 16, the resolution of the carriage position details is 2400 (=150×16) dpi.

Another inkjet print device in accordance with the present invention is arranged as in the foregoing, and characterized in that the time measurement means obtains the output pulse cycle as digital data; and the position details sensing means shifts data of the output pulse cycle time-measured by the time measurement means toward the right by a predetermined number of times so as to divide the output pulse cycle.

According to the arrangement, the output pulse cycle can be readily divided merely by shifting the data of the output pulse cycle time-measured by the time measurement means. Thus, the carriage position details can be readily determined.

When this is the case, the number by which the cycle is divided is a power of 2. Its power indicates the number of shifts.

Another inkjet print device in accordance with the present invention is arranged as in the foregoing, and characterized in that the position sensing means contains approximate count means for measuring a number of pulses of the pulse signal output from the encoder; and a combined value of a count by the approximate coefficient means as high order digits and a count by the details count means as low order digits is the carriage position.

The position details sensing means may determine an absolute position of the carriage or a relative position of the carriage. To determine a relative position of the carriage, the position sensing means further contains approximate position sensing means which senses an approximate position of the carriage by measuring the number of pulses of the pulse signal output from the encoder. With the count by the approximate position sensing means being designated as high order digits, the count by the position details sensing means as low order digits, and the combined value as the carriage position, the absolute position of the carriage can be determined.

A method of controlling an inkjet print device in accordance with the present invention a method of controlling an inkjet print device which prints by reciprocally moving a carriage carrying a print head in a main scan direction while controlling ink ejection from the print head according to a carriage position both in a forward movement and in a return movement, the device including position sensing means for sensing the carriage position and speed sensing means for sensing moving speed of the carriage, the method including: the relationship setting step of presetting a relationship between the moving speed of the carriage and a positional correction quantity for correcting a discrepancy in an ink hitting position resulting from the ink ejection from the print head while the carriage is moving; the correction quantity determining step of determining the positional correction quantity from the moving speed of the carriage sensed by the speed sensing means according to the relationship preset in the relationship setting step; the ejection control step of controlling the ink ejection from the print head according to the positional correction quantity determined in the correction quantity determining step and the carriage position sensed by the position sensing means.

According to the method, even if the carriage speed changes, a suitable positional correction quantity can be determined according to the relationship between the positional correction quantity and the carriage speed. Thus, the ink ejection from the print head is controlled with the suitable positional correction quantity. Good image quality is available even while the carriage is accelerating or decelerating. Hence, the device can print in the accelerate/decelerate areas flanking the constant-speed area, achieving reduced print time and reduced device size.

The correction quantity determining means and the ejection control means in the inkjet print device can be realized by an inkjet print program on a computer. Further, by storing the inkjet print program on a computer-readable storage medium, the inkjet print program can be executed on any given computer.

The embodiments and examples described in Best Mode for Carrying Out the Invention are for illustrative purposes only and by no means limit the scope of the present invention. Variations are not to be regarded as a departure from the spirit and scope of the invention, and all such modifications as would be obvious to one skilled in the art are intended to be included within the scope of the claims below.

INDUSTRIAL APPLICABILITY

According to the present invention, an inkjet print device is provided capable of determining a suitable positional correction quantity even if the moving speed of the carriage changes and achieving good image quality even while the device is accelerating or decelerating.

Thus, the device can print in the accelerate/decelerate areas flanking the constant-speed area, achieving reduced print time and reduced device size.

The invention claimed is:

1. An inkjet print device which prints by reciprocally moving a carriage carrying a print head in a main scan direction while controlling ink ejection from the print head according to a carriage position both in a forward movement and in a return movement, said device comprising:

position sensing means for sensing the carriage position;

speed sensing means for sensing moving speed of the carriage;

correction quantity determining means for presetting a relationship between a reference moving speed of the carriage and a reference positional correction quantity for correcting a discrepancy in an ink hitting position resulting from the ink ejection from the print head while the carriage is moving at the reference moving speed of the carriage, and for determining a positional correction quantity for correcting a discrepancy in an ink hitting position resulting from the ink ejection from the print head while the carriage is moving at the reference moving speed of the carriage, said correction quantity determining means determining the position correction quantity from the preset relationship and from the moving speed of the carriage sensed by the speed sensing means according to the preset relationship; and ejection control means for controlling the ink ejection from the print head according to the positional correction quantity determined by the correction quantity determining means and the carriage position sensed by the position sensing means, wherein:

the position sensing means contains an encoder producing a pulse signal output according to a displacement of the carriage;

the speed sensing means contains time measurement means for measuring a cycle of the pulse signal output from the encoder; and the correction quantity determining means presets a relationship between the cycle of the pulse signal output corresponding to the reference moving speed and the reference positional correction quantity and determines the positional correction quantity from the preset relationship and from the cycle of the pulse signal output measured by the time measurement means, wherein the relationship between the cycle of the pulse signal output corresponding to the reference moving speed and the reference positional correction quantity is an inversely proportional relationship, and wherein the correction quantity determining means prestores a correction quantity table representing a relationship between multiple cycles of the pulse signal output and multiple positional correction quantities and determines the positional correction quantity from the cycle of the pulse signal output measured by the time measurement means in the speed sensing means in reference to the correction quantity table.

2. A computer-readable storage medium containing an inkjet print program for causing the inkjet print device as set forth in claim 1 to operate, wherein the program causes a computer to function as the correction quantity determining means and the ejection control means.

* * * * *